US011473831B2

(12) United States Patent
Tsutsumi

(10) Patent No.: US 11,473,831 B2
(45) Date of Patent: Oct. 18, 2022

(54) AIR-CONDITIONING APPARATUS

(71) Applicant: Mitsubishi Electric Corporation, Tokyo (JP)

(72) Inventor: Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/763,314

(22) PCT Filed: Jan. 12, 2018

(86) PCT No.: PCT/JP2018/000596
§ 371 (c)(1),
(2) Date: May 12, 2020

(87) PCT Pub. No.: WO2019/138533
PCT Pub. Date: Jul. 18, 2019

(65) Prior Publication Data
US 2020/0318887 A1 Oct. 8, 2020

(51) Int. Cl.
*F25D 21/14* (2006.01)
*F25D 21/02* (2006.01)

(52) U.S. Cl.
CPC ..... *F25D 21/14* (2013.01); *F25D 21/02* (2013.01)

(58) Field of Classification Search
CPC ..... F24F 11/36; F24F 13/222; F24F 13/22; F25D 21/02; F25D 21/14
USPC ..... 73/40, 70.7
See application file for complete search history.

(56) References Cited

U.S. PATENT DOCUMENTS

2002/0000093 A1* 1/2002 Lea ..... F24F 13/222 62/150
2009/0064698 A1* 3/2009 Spanger ..... F24F 13/222 62/289
2009/0229784 A1* 9/2009 Rohr ..... G01B 11/22 165/301
2010/0005815 A1* 1/2010 Yanagida ..... F25B 45/00 62/149
2010/0050756 A1* 3/2010 Stewart ..... F24F 13/22 73/114.55
2011/0061415 A1* 3/2011 Ward ..... F04B 49/04 700/282

(Continued)

FOREIGN PATENT DOCUMENTS

JP 2016-109356 A 6/2016

*Primary Examiner* — Nelson J Nieves
*Assistant Examiner* — Meraj A Shaikh
(74) *Attorney, Agent, or Firm* — Posz Law Group, PLC

(57) ABSTRACT

An air-conditioning apparatus includes an outdoor unit and an indoor unit between which refrigerant is circulated. The indoor unit includes a body casing that forms an outer shell, a heat exchanger provided in the body casing, a drain pan provided below the heat exchanger, a water-level detecting unit that detects the level of condensate water that has flowed into the drain pan, and a refrigerant-gas detecting unit that is provided in the drain pan and at a higher level than the water-level detecting unit, and detects refrigerant gas that has leaked from the heat exchanger. The air-conditioning apparatus includes a controller that performs control to stop a cooling operation when the water-level detecting unit detects the condensate water that collects in the drain pan.

10 Claims, 5 Drawing Sheets

(56) References Cited

U.S. PATENT DOCUMENTS

| | | | | |
|---|---|---|---|---|
| 2011/0277541 | A1* | 11/2011 | Kadle | B60H 1/00978 73/40 |
| 2014/0196483 | A1* | 7/2014 | Okazaki | F25B 25/005 62/126 |
| 2016/0091241 | A1* | 3/2016 | Suzuki | F25D 17/067 62/186 |
| 2017/0350614 | A1 | 12/2017 | Nagaoka et al. | |
| 2018/0119967 | A1* | 5/2018 | Keshavan Raghavan | F24F 3/1405 |
| 2019/0390877 | A1* | 12/2019 | Sakae | F25B 1/00 |

* cited by examiner

AIR-CONDITIONING APPARATUS

CROSS REFERENCE TO RELATED APPLICATION

This application is a U.S. national stage application of PCT/JP2018/000596 filed on Jan. 12, 2018, the contents of which are incorporated herein by reference.

TECHNICAL FIELD

The present disclosure relates to an air-conditioning apparatus including a refrigerant-gas detecting unit.

BACKGROUND ART

Some existing air-conditioning apparatuses use, for example, R32, as refrigerant. It is known that R32 does not destroy ozone and has a low global warming potential, but it is flammable refrigerant. For example, Patent Literature 1 discloses an air-conditioning apparatus that includes a floor-standing indoor unit and uses flammable refrigerant or slightly flammable refrigerant. In the indoor unit, a refrigerant gas detection sensor is provided to detect refrigerant gas that has leaked from an indoor heat exchanger. The air-conditioning apparatus is configured such that when the refrigerant gas detection sensor detects refrigerant gas, a fan in the indoor unit is controlled to operate to stir the refrigerant gas, thereby preventing the refrigerant gas from locally collecting in a room.

CITATION LIST

Patent Literature

Patent Literature 1: Japanese Unexamined Patent Application Publication No. 2016-109356

SUMMARY OF INVENTION

Technical Problem

Refrigerant gas has a higher specific gravity than air, and thus flows to a lower region located blow an indoor heat exchanger and collects in the lower region. It is therefore preferable that a refrigerant gas sensor be provided in the lower region located below the heat exchanger, in which the density of refrigerant gas is the highest. However, in the lower region, a drain pan is provided below the indoor heat exchanger to receive condensate water (dew condensation) generated on the indoor heat exchanger. The condensate water that is received and collected in the drain pan is discharged to the outside by a drain pump. However, the drain pump may be dogged or become out of order, as a result of which the condensate water may not be normally discharged. In such a case, the refrigerant gas sensor may be submerged in the condensate water that collects in the drain pan, broken, and thus fail to detect the refrigerant gas.

The present disclosure is applied to solve the above problem, and relates to an air-conditioning apparatus that reliably prevents a failure to detect refrigerant gas leak that is caused by condensate water collecting in a drain pan.

Solution to Problem

An air-conditioning apparatus according to an embodiment of the present disclosure includes an outdoor unit and an indoor unit between which refrigerant is circulated. The indoor unit includes a body casing that forms an outer shell, a heat exchanger provided in the body casing, a drain pan provided below the heat exchanger, a water-level detecting unit that detects the level of condensate that has flowed into the drain pan, and a refrigerant-gas detecting unit that is provided in the drain pan and at a higher level than the water-level detecting unit, and detects refrigerant gas that has leaked from the heat exchanger. The controller performs control to stop a cooling operation when the water-level detecting unit detects the condensate water that collects in the drain pan.

Advantageous Effects of Invention

According to the embodiment of the present disclosure, the refrigerant-gas detecting unit is provided at a higher level than the water-level detecting unit. When the water-level detecting unit detects the condensate water that collects in the drain pan, the controller performs control to stop the cooling operation. It is therefore possible to prevent the refrigerant-gas detecting unit from being submerged in the condensate water that collects in the drain pan, and thus reliably prevent a failure to detect a refrigerant gas leak, which would be caused by the condensate water collecting in the drain pan.

DESCRIPTION OF EMBODIMENTS

Embodiments of the present disclosure will be described with reference to the above figures. It should be noted that in each of the figures, components that are the same as or equivalent to those in a previous figure are denoted by the same reference signs, and after each component is explained once, a description thereof will be omitted or simplified as appropriate. Furthermore, for example, the shapes, sizes, and arrangement of components as illustrated in each figure can be appropriately changed within the scope of the present disclosure.

Embodiment 1

Figure 1:
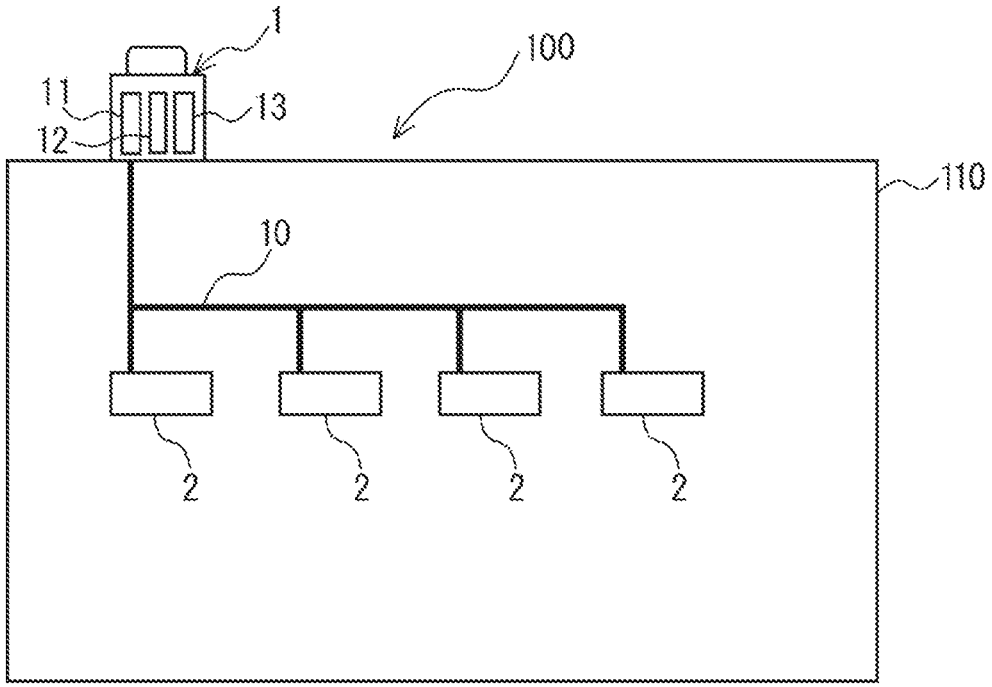
FIG. 1 is a schematic diagram of an overall configuration of an air-conditioning apparatus according to Embodiment 1 of the present disclosure that is used as a variable refrigerant flow system.

FIG. 1 is a schematic diagram of an overall configuration of an air-conditioning apparatus according to Embodiment 1 of the present disclosure that is used as a variable refrigerant flow system. An air-conditioning apparatus 100 according to Embodiment 1 is configured to circulate refrigerant between an outdoor unit 1 and an indoor unit 2. In the case where the air-conditioning apparatus 100 is used as a variable refrigerant flow system, as illustrated in FIG. 1, the outdoor unit 1 is installed on the rooftop of a building 110 and a plurality of ceiling concealed indoor units 2 are installed inside the building 110. The outdoor unit 1 is connected to the indoor units 2 by a refrigerant pipe 10. Also, the outdoor unit 1 and the indoor units 2 are connected by communication lines (not illustrated) such that information can be transmitted between the outdoor unit 1 and the indoor units 2.

The air-conditioning apparatus 100 according to Embodiment 1 uses flammable refrigerant or slightly flammable refrigerant. To be more specific, the apparatus uses, for example, R32 refrigerant that does not destroy ozone and has a low global warming potential.

The outdoor unit 1 is configured such that a compressor 11, an outdoor heat exchanger, an outdoor fan 12, and an expansion valve 13 are housed in a housing which forms an outer shell of the outdoor unit 1. The compressor 11 compresses refrigerant, the outdoor heat exchanger causes heat exchange to be performed between the refrigerant and air, the outdoor fan 12 supplies air to the outdoor heat exchanger, and the expansion valve 13 reduces the pressure of refrigerant that passes through the outdoor heat exchanger.

Figure 2:
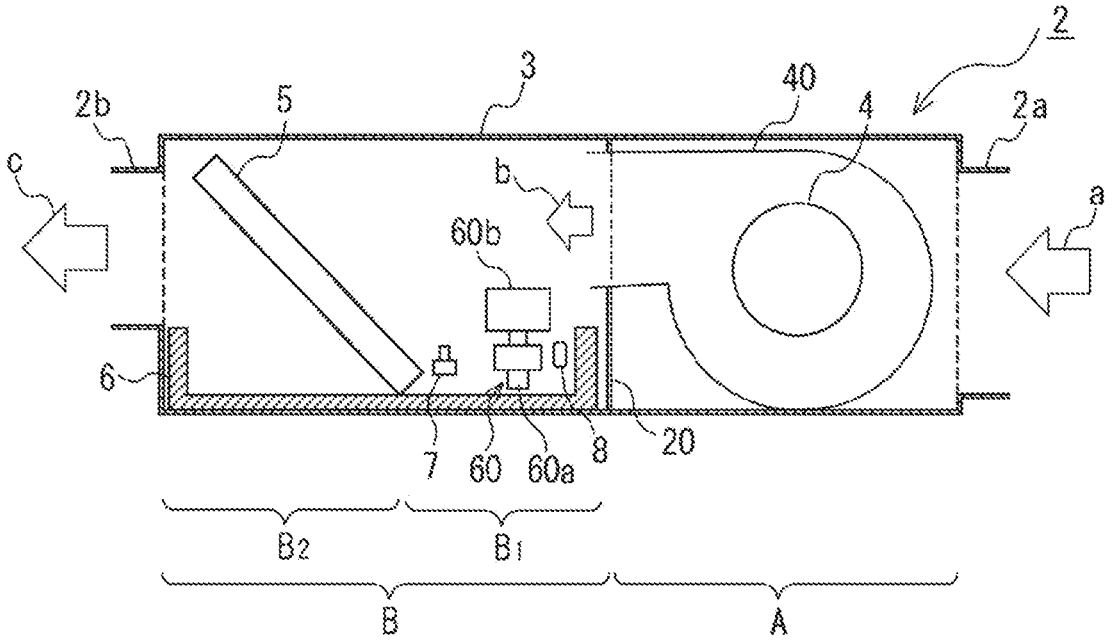
FIG. 2 is a schematic side view of an internal configuration of an indoor unit of the air-conditioning apparatus according to Embodiment 1 of the present disclosure.
Figure 3:
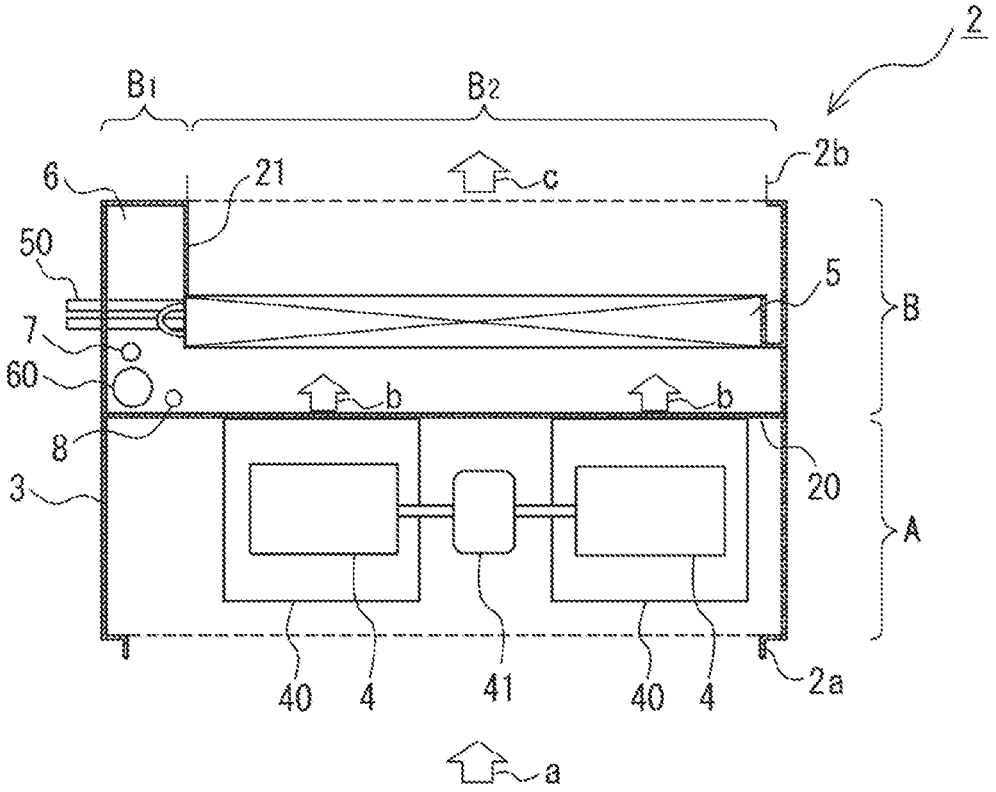
FIG. 3 is a schematic plan view of the internal configuration of the indoor unit of the air-conditioning apparatus according to Embodiment 1 of the present disclosure.
Figure 4:
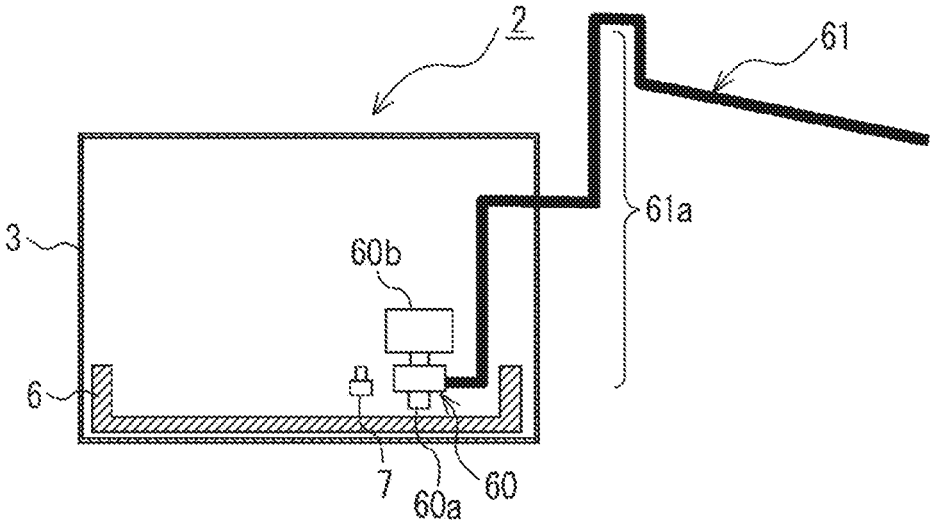
FIG. 4 is a schematic diagram illustrating a relationship between a drain pump and a drain hose in the air-conditioning apparatus according to Embodiment 1 of the present disclosure.

FIG. 2 is a schematic side view of an internal configuration of an indoor unit in the air-conditioning apparatus according to Embodiment 1 of the present disclosure. FIG. 3 is a schematic plan view of the internal configuration of the indoor unit of the air-conditioning apparatus according to Embodiment 1 of the present disclosure. FIG. 4 is a schematic diagram illustrating a relationship between a drain pump and a drain hose in the air-conditioning apparatus according to Embodiment 1 of the present disclosure. The indoor unit 2 as illustrated in FIG. 2 is of a ceiling concealed type, for example. The indoor unit 2 is configured such that indoor fans 4, an indoor heat exchanger 5, a drain pan 6, a drain pump 60, a water-level detecting unit 7, and a refrigerant-gas detecting unit 8 are housed in a body casing 3 that forms an outer shell of the indoor unit 2.

As illustrated in FIGS. 2 and 3, the inside of the body casing 3 is partitioned into a fan portion A and a heat-exchanger portion B by a partition plate 20. In the fan portion A, an air inlet 2*a* is provided to communicate with the outside of the body casing 3. In the heat-exchanger portion B, an air outlet 2*b* is provided to communicate with the outside of the body casing 3.

In the fan portion A, the indoor fans 4 are housed in respective fan cases 40 and arranged side by side. The indoor fans 4 are, for example, cross-flow fans or tangential fans, and are provided to suck indoor air through the air inlet 2*a* and blow conditioned air through the air outlet 2*b*. A motor unit 41 that drives the indoor fans 4 is provided at the midpoint between the two indoor fans 4. The fan casings 40 are fixed to the partition plate 20. The partition plate 20 has such a strength that the partition plate 20 can support each of the indoor fans 4 when each indoor fan 4 is driven.

The heat-exchanger portion B is partitioned into a primary side $B_1$ and a secondary side $B_2$ by the indoor heat exchanger 5 and a partition plate 21. The partition plate 21 is fixed to a side plate of the indoor heat exchanger 5 by a fixing member such as a screw. It should be noted that the side plate of the indoor heat exchanger 5 may be extended in order that this extension of the side plate be used as the partition plate 21.

The indoor heat exchanger 5 causes heat exchange to be performed between refrigerant that flows in the indoor heat exchanger 5 and air sent from the indoor fans 4. The indoor heat exchanger 5 includes a plurality of fins that are spaced from each other and heat transfer tubes that are attached to the fins in such a manner as to extend through the fins in a direction along the thickness of each of the fins. Each fin is a fin subjected to hydrophilic treatment in order that generated condensate water can smoothly flow over the fin. Condensate water flows over the fins without dripping, and flows into the drain pan 6 provided below the indoor heat exchanger 5. The drain pan 6 extends over the primary side $B_1$ and the secondary side $B_2$ below the indoor heat exchanger 5, and is provided to receive condensate water generated on the indoor heat exchanger 5. It should be noted that the drain pan 6 has an inclined surface at a bottom portion of the drain pan 6. The condensate water that has flowed into the drain pan 6 is collected at a certain region in the drain pan 6 by the inclined surface of the drain pan 6.

In the primary side $B_1$ of the heat-exchanger portion B, a refrigerant-circuit portion 50, the drain pump 60, the water-level detecting unit 7, and the refrigerant-gas detecting unit 8 are provided. In the secondary side $B_2$ of the heat-exchanger portion B, the air outlet 2*b* is provided and communicates with the outside of the body casing 3.

The refrigerant-circuit portion 50 distributes the refrigerant to the tubes and causes the refrigerant into the indoor heat exchanger 5. The drain pump 60 includes a suction inlet 60*a* for condensate water and a motor unit 60*b* that is provided to drive the drain pump 60. The drain pump 60 is provided at a position corresponding to the deepest part of the inclined surface at the bottom of the drain pan 6. The drain pump 60 draws condensate water collected in the drain pan 6 through the suction inlet 60*a*, and discharges the condensate water to the outside of the indoor unit 2 through a drain hose 61, as illustrated in FIG. 4. The refrigerant-circuit portion 50 and the drain pump 60 are separated from the indoor fans 4 by the greatest possible distance such that the refrigerant-circuit portion 50 and the drain pump 60 are not affected by the air blown from the indoor fans 4. In Embodiment 1 as illustrated in FIG. 4, the drain hose 61 includes a raised portion 61*a* that extends upwards from an end of the drain hose 61 that is connected to the drain pump 60.

Figure 5:
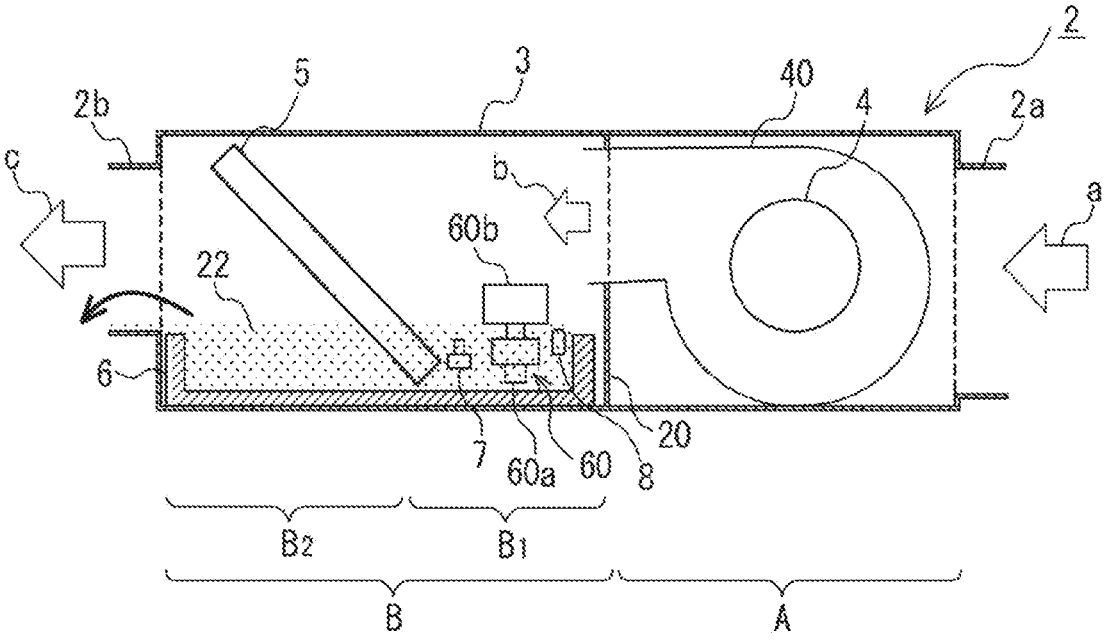
FIG. 5 is a schematic diagram illustrating a relationship between the drain pump and refrigerant gas that collects in a drain pan in the air-conditioning apparatus according to Embodiment 1 of the present disclosure.

FIG. 5 is a schematic diagram illustrating a relationship between the drain pump and refrigerant gas that collects in the drain pan in the air-conditioning apparatus according to Embodiment 1 of the present disclosure. In the indoor unit 2, if refrigerant gas 22, which is flammable, leaks from the indoor heat exchanger 5, it may cause the motor unit 60*b* to catch fire when the motor unit 60*b* is being driven. In Embodiment 1, the motor unit 60*b* of the drain pump 60 is provided above the drain pan 6 and at a level corresponding to a lower portion of the air outlet 2*b*. Since the motor unit 60*b* of the drain pump 60 is provided in the above manner, the motor unit 60*b* can be kept away from the refrigerant gas 22, because the refrigerant gas 22 that collects in the drain pan 6 flows over the drain pan 6 and is then discharged through the air outlet 2*b*, as illustrated in FIG. 5.

Figure 6:
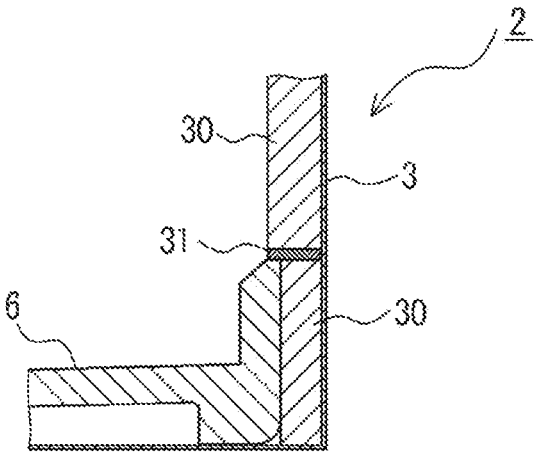
FIG. 6 is an enlarged schematic view of part of a sealing structure of the air-conditioning apparatus according to Embodiment 1 of the present disclosure.

FIG. 6 is an enlarged schematic view of part of a sealing structure of the air-conditioning apparatus according to Embodiment 1 of the present disclosure. In the indoor unit 2, condensate water is also generated at the refrigerant-circuit portion 50, which is connected to the indoor heat exchanger 5. Condensate water generated on the refrigerant-circuit portion 50 collects as droplets of water at the lowest part of pipes included in the refrigerant-circuit portion 50 and then drips into the drain pan 6, since no flow passage is provided from the refrigerant-circuit portion 50 to the drain pan 6. Even in the configuration in which the refrigerant-circuit portion 50 is separated from the indoor fans 4 by the greatest possible distance in order to prevent the refrigerant-circuit portion 50 from being affected by an air flow, when condensate water drips as water droplets from the refrigerant-circuit portion 50, the water droplets may be brought, by the air flow, into contact with a wall-surface portion 30 such as heat insulating material. The water droplets on the wall-surface portion 30 will flow over the wall-surface portion 30 toward the drain pan 6. However, if a gap is present between the drain pan 6 and the wall-surface portion 30, the condensate water may flow out of the indoor unit 2 through the gap without flowing into the drain pan 6.

In Embodiment 1, the drain pan 6 includes a sealing structure 31 to guide into the drain pan 6, a water droplet that flows over the wall-surface portion 30 provided on the inner surface of the body casing 3. The sealing structure 31 is, for example, a sealing member such as packing, which closes the gap between the drain pan 6 and the wall-surface portion 30. Another member may be used as the sealing structure 31 as long as it can guide water droplets that flows over the wall-surface portion 30 provided on the inner surface of the body casing 3, into the drain pan 6. Furthermore, the sealing structure 31 does not need to be provided in the case where it is assumed that condensate water does not flow to the outside of the indoor unit 2 through the gap between the drain pan 6 and the wall-surface portion 30.

The water-level detecting unit 7 is, for example, a water level sensor, and detects condensate water that collects in the drain pan 6. The water-level detecting unit 7 is provided in the drain pan 6 and at a higher level than the suction inlet 60*a* of the drain pump 60.

In the indoor unit 2, when the drain pump 60 is operated, condensate water that collects in the drain pan 6 is sucked into the drain pump 60 through the suction inlet 60*a*, and the condensate water is discharged to the outside of the indoor unit 2 through the drain hose 61. At this time, when the drain pump 60 is stopped, at the raised portion 61*a* of the drain hose 61 as illustrated in FIG. 4, the water flows backward and returns to the drain pan 6, and as a result, the level of water in the indoor unit 2 rises. Furthermore, even when a cooling operation of the indoor unit 2 is stopped, the condensate water on the indoor heat exchanger 5 will not stop for a while, that is, it will continuously flow into the drain pan 6 for a while. At this time, when the water-level detecting unit 7 detects water that collects in the drain pan 6, a controller 9 may determine by mistake that a failure occurs in discharge of water. For this reason, it is preferable that the water-level detecting unit 7 be separated upwardly from the bottom of the drain pan 6 by the greatest possible distance. However, in the case where the water-level detecting unit 7 is provided at a too high position in the indoor unit 2, the following problem will occur: for example, if a discharge failure occurs, when the water-level detecting unit 7 detects the level of collected water, and a refrigerant operation is stopped, the level of the collected water rises since the water is returned from the drain hose 61, and the water overflows from the drain pan 6. The level at which the water-level detecting unit 7 is provided is determined in consideration of the above circumstances.

The refrigerant-gas detecting unit 8 is, for example, a gas sensor, and detects the refrigerant gas that has leaked from the indoor heat exchanger 5. The refrigerant-gas detecting unit 8 is provided in the drain pan 6 and at a higher level than the water-level detecting unit 7. The refrigerant-gas detecting unit 8 may be fixed to an inner wall of the drain pan 6, or may be provided using another member. The refrigerant gas has a higher density than air, and thus tends to flow to a region in which a lower portion of the indoor heat exchanger 5 is located, and to collect in the drain pan 6. Thus, in order to early detect a refrigerant gas leak, the refrigerant-gas detecting unit 8 is provided in a region in the drain pan 6 where the density of the refrigerant gas is the highest.

Figure 7:
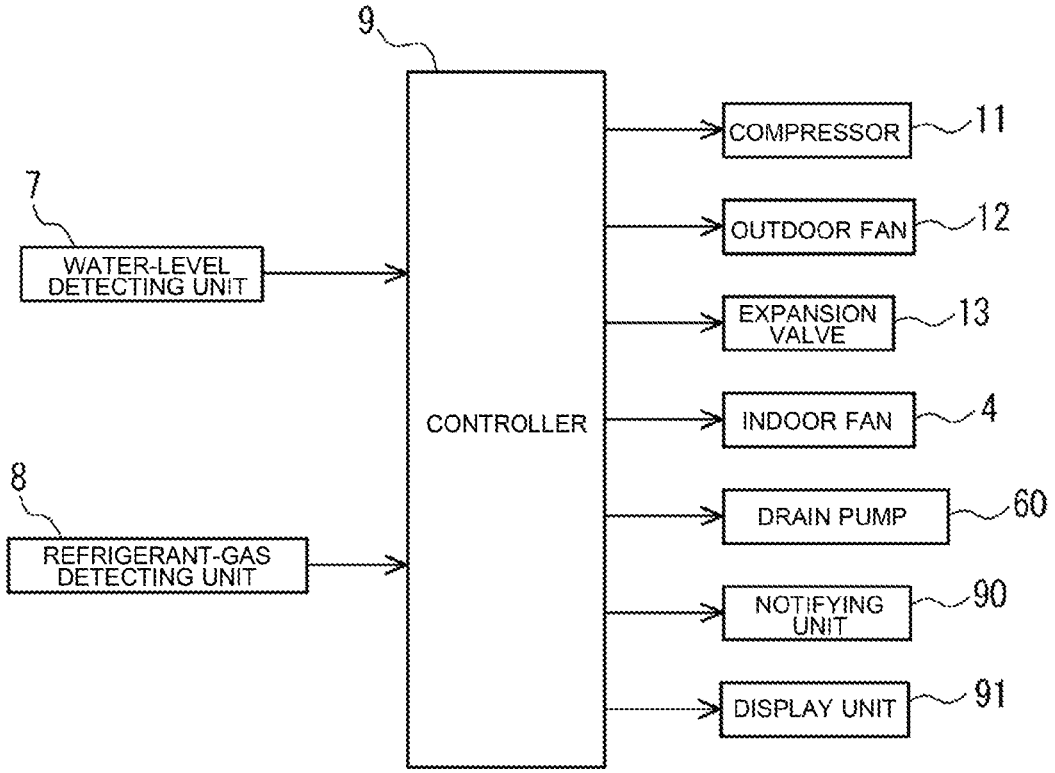
FIG. 7 is a block diagram of a control system of the air-conditioning apparatus according to Embodiment 1 of the present disclosure.

FIG. 7 is a block diagram of a control system of the air-conditioning apparatus according to Embodiment 1 of the present disclosure. The air-conditioning apparatus 100 includes the controller 9 that controls an operation of the outdoor unit 1 and an operation of the indoor unit 2. The controller 9 includes an arithmetic device such as a microcomputer or a central processing unit (CPU) and software that runs on the arithmetic device. The controller 9 may be hardware such as a circuit device that fulfills functions of the controller 9.

To an input side of the controller 9, the water-level detecting unit 7 and the refrigerant-gas detecting unit 8 are connected. To an output side of the controller 9, the compressor 11, the outdoor fan 12, the expansion valve 13, the indoor fans 4, the drain pump 60, a notifying unit 90, and a display unit 91 are connected.

The notifying unit 90 makes a notification indicating an operation state of the outdoor unit 1 and an operation state of the indoor unit 2. The notifying unit 90 is, for example, a buzzer, a speaker, or a monitor that is provided at the outdoor unit 1 or the indoor unit 2. The notifying unit 90 is not limited to the above devices, and any device can be applied as the notifying unit 90 as long as it can notify a person or people around the notifying unit 90 of the operation states of the outdoor unit 1 and the indoor unit 2.

The display unit 91 displays information indicating the operation state of the outdoor unit 1 and that of the indoor unit 2. The display unit 91 is, for example, a monitor or a lamp that is provided at the outdoor unit 1 or the indoor unit 2, or a remote controller for use in operating the indoor unit 2. The display unit 91 is not limited to the above devices, and any device may be applied as the display unit 91 as long as it can display information indicating the operation states of the outdoor unit 1 and the indoor unit 2.

An operation of the indoor unit 2 of the air-conditioning apparatus 100 according to Embodiment 1 will be described. In the indoor unit 2, when the indoor fans 4 are rotated, a suction side of each of the fan casings 40 in the fan portion A has a negative pressure. As a result, air in a room in the building 110 is sucked into the body casing 3 through the air inlet 2*a*, as indicated by an arrow a. The sucked air passes through the fan casings 40 and is then blown to the primary side $B_1$ of the heat-exchanger portion B, as indicated by an arrow b. The air blown to the primary side $B_1$ of the heat-exchanger portion B passes through the indoor heat exchanger 5 and the secondary side $B_2$ of the heat-exchanger portion B and is then blown out of the body casing 3 through the air outlet 2*b*, as indicated by an arrow c. The air blown through the air outlet 2*b* passes through, for example, a duct provided in the place of installation of the indoor unit 2 and is then blown into the room.

In the cooling operation of the indoor unit 2, when the refrigerant in the indoor heat exchanger 5 exchanges heat with the sucked air, and then when the temperature of the refrigerant in the indoor heat exchanger 5 decreases to be at or below a dew-point temperature of water vapor contained in the air, condensate water (dew condensation) generates at the indoor heat exchanger 5. The condensate water flows along the fins of the indoor heat exchanger 5 without dripping, and flows into the drain pan 6. The condensate water that has flowed into the drain pan 6 is collected in the certain region in the drain pan 6 by the inclined surface at the bottom of the drain pan 6, and is then discharged to the outside of the indoor unit 2 through the drain hose 61 by operating the drain pump 60 provided at the deepest part of the drain pan 6.

In the indoor unit 2, for example, if the drain pump 60 is clogged or a failure occurs in the drain pump 60, there is a case where the condensate water collecting in the drain pan 6 cannot be normally discharged. In the indoor unit 2, when the level of the condensate water collecting in the drain pan 6 gradually rises, and then reaches the water-level detecting unit 7 provided at a higher level than the suction inlet 60*a* of the drain pump 60, the water-level detecting unit 7 detects the condensate water. When the water-level detecting unit 7 detects the condensate water collecting in the drain pan 6, the controller 9 determines that the condensate water collecting in the drain pan 6 is at an abnormal level, and performs control to stop the cooling operation by transmitting a signal to the compressor 11 to stop the compressor. The controller 9 may stop the cooling operation by transmitting a signal to the expansion valve 13 to stop the expansion valve 13.

The controller 9 may be configured as follows: when determining, based on detection information from the water-level detecting unit 7, that the level of the condensate water collecting in the drain pan 6 reaches the abnormal level, the controller 9 transmits a signal indicating the determination to the notifying unit 90 to cause the notifying unit 90 to give an alarm to the person or people around the notifying unit 90; and alternatively, when determining, based on the detection information from the water-level detecting unit 7, that the level of the condensate water collecting in the drain pan 6 reaches the abnormal level, the controller 9 transmits a signal indicating the determination to the display unit 91 to cause the display unit 91 to display information indicating that the condensate water is at the abnormal level.

In the indoor unit 2, if refrigerant gas leaks from the indoor heat exchanger 5, the refrigerant gas flows to the lower region located below the indoor heat exchanger 5 and collects in the lower region. The refrigerant-gas detecting unit 8 detects the refrigerant gas that collects in the lower region. When the controller 9 determines, based on detection information from the refrigerant-gas detecting unit 8, that refrigerant gas leaks from the indoor heat exchanger 5, the controller 9 performs control to transmit a signal to the compressor 11 to stop the compressor 11 and thus stop the cooling operation, and also to transmit a signal to the drain pump 60 to stop the drain pump 60. The reason that the drain pump 60 is stopped is that the motor unit 60*b* being in the driving state may catch fire due to the flammable refrigerant gas. It should be noted that the controller 9 may be configured to stop the cooling operation by transmitting a signal to the expansion valve 13 to stop the expansion valve 13. The indoor unit 2 may be configured such that the controller 9 controls the indoor fans 4 to send air to refrigerant gas and thus circulate the refrigerant gas; that is, the refrigerant gas is prevented from locally collecting.

The controller 9 may be configured as follows: when determining, based on detection information from the refrigerant-gas detecting unit 8, that refrigerant gas leaks from the indoor heat exchanger 5, the controller 9 transmits a signal indicating the determination to the notifying unit 90 to cause the notifying unit 90 to give an alarm in order to notify the person or people around the notifying unit 90 of the refrigerant gas leak; and alternatively, when determining, based on detection information from the refrigerant-gas detecting unit 8, that refrigerant gas leaks from the indoor heat exchanger 5, the controller 9 transmits a signal indicating the determination to the display unit 91 to cause the display unit 91 to display information indicating the refrigerant gas leak.

Preferably, also after the cooling operation of the indoor unit 2 is stopped, the drain pump 60 should be controlled to continuously operate for a predetermined period of time and thus cause condensate water adhering to the indoor heat exchanger 5 to be discharged. This is because the controller 9 may determine by mistake that a discharge failure occurs when the water-level detecting unit 7 detects condensate water re-collecting in the drain pan 6.

Figure 8:
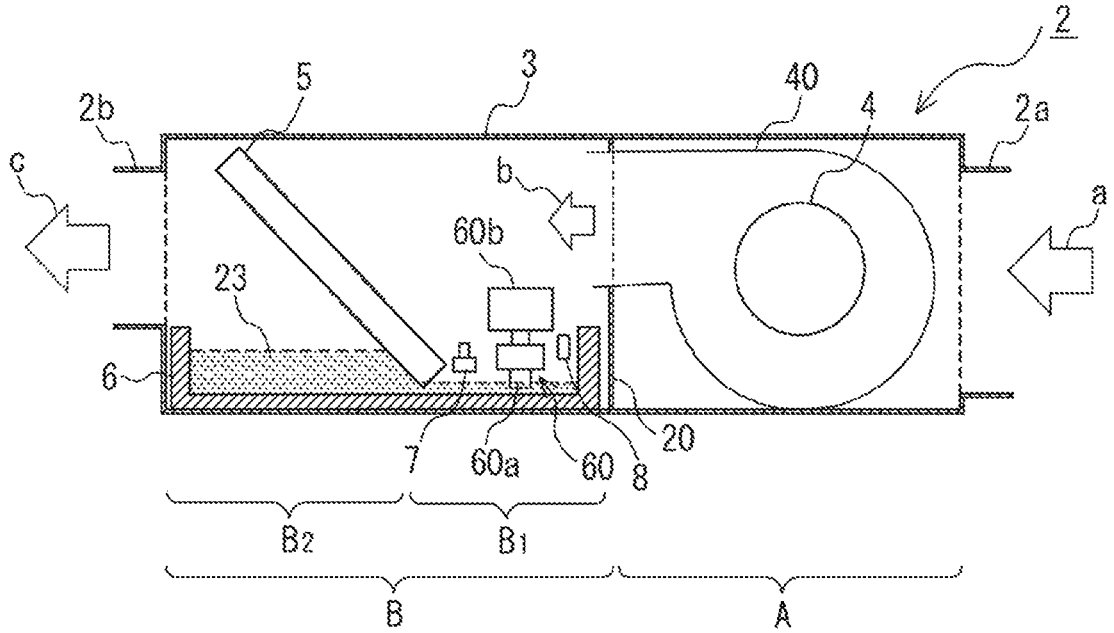
FIG. 8 is a schematic diagram illustrating a relationship between condensate water that collects in a primary side of a heat-exchanger portion and condensate water that collects in a secondary side of the heat-exchanger portion in the air-conditioning apparatus according to Embodiment 1 of the present disclosure.

FIG. 8 is a schematic diagram illustrating a relationship between condensate water that collects in the primary side of the heat-exchanger portion and that in the secondary side thereof in the air-conditioning apparatus according to Embodiment 1 of the present disclosure. In the indoor unit 2, during an operation of the indoor fans 4, the pressure in the primary side $B_1$ is different from that in the secondary side $B_2$ and this pressure difference corresponds to a pressure loss in the indoor heat exchanger 5. Thus, condensate water 23 collects in the drain pan 6 such that the water level of the condensate water 23 in the primary side $B_1$ varies from that in the secondary side $B_2$. When the indoor fans 4 are in operation, the condensate water that collects in the primary side $B_1$ is actively discharged by the drain pump 60, and the water level in the primary side $B_1$ is thus lower than that in the secondary side $B_2$. When the indoor fans 4 are stopped, the condensate water in the secondary side $B_2$ flows to the primary side $B_1$, and the water level in the primary side $B_1$ thus rises. Therefore, in the air-conditioning apparatus 100, it is preferable that the drain pump 60 be continuously operated for the predetermined period of time after the indoor fans 4 are stopped.

As described above, in the air-conditioning apparatus 100 according to Embodiment 1, the refrigerant-gas detecting unit 8 is provided at a higher level than the water-level detecting unit 7, and the controller 9 performs control to stop the cooling operation when the water-level detecting unit 7 detects condensate water that collects in the drain pan 6. In the air-conditioning apparatus 100, the refrigerant-gas detecting unit 8 is thus prevented from being submerged in the condensate water collecting in the drain pan 6. It is therefore possible to reliably prevent a failure to detect a refrigerant gas leak that would be caused by the condensate water collecting in the drain pan 6.

The air-conditioning apparatus 100 according to Embodiment 1 includes the notifying unit 90 that makes a notification indicating an operation state of the outdoor unit 1 and an operation state of the indoor unit 2. The controller 9 causes the notifying unit 90 to make a notification based on detection information from the water-level detecting unit 7 or the refrigerant-gas detecting unit 8. Thus, when the water level of condensate water that collects in the drain pan 6 reaches the abnormal level, the air-conditioning apparatus 100 can cause the notifying unit 90 to give an alarm in order to notify the person or people around the notifying unit 90 of such an abnormal state. It is therefore possible to effectively prevent the refrigerant-gas detecting unit 8 from being submerged in condensate water collecting in the drain pan 6. Furthermore, in the air-conditioning apparatus 100, if refrigerant gas leaks from the indoor heat exchanger 5, the air-conditioning apparatus 100 can cause the notifying unit 90 to give an alarm in order to notify the person or people around the notifying unit 90 of the refrigerant gas leak. It is therefore possible to effectively prevent a dangerous accident such as ignition.

The air-conditioning apparatus 100 according to Embodiment 1 includes the display unit 91 that displays information indicating the operation state of the outdoor unit 1 and that of the indoor unit 2. The controller 9 causes the display unit 91 to display the above information based on detection information from the water-level detecting unit 7 or the refrigerant-gas detecting unit 8. Thus, when the level of condensate water that collects in the drain pan 6 reaches the abnormal level, the air-conditioning apparatus 100 can cause the display unit 91 to display information indicating that the condensate water is at the abnormal level. It is therefore possible to effectively prevent the refrigerant-gas detecting unit 8 from being submerged in the condensate water collecting in the drain pan 6. Furthermore, if refrigerant gas leaks from the indoor heat exchanger 5, the air-conditioning apparatus 100 can cause the display unit 91 to display information indicating the refrigerant gas leak. It is therefore possible to effectively prevent a dangerous accident such as ignition.

In the air-conditioning apparatus 100 according to Embodiment 1, the indoor unit 2 includes the drain pump 60 that draws condensate water collecting in the drain pan 6 and causes the condensate water to be discharged to the outside. When the refrigerant-gas detecting unit 8 detects refrigerant gas, the controller 9 performs control to stop driving of the drain pump 60. Therefore, in the air-conditioning apparatus 100, it is possible to reliably prevent a dangerous accident in which the motor unit 60*b* being in the driving state is made to catch fire by flammable refrigerant gas.

In the air-conditioning apparatus 100 according to Embodiment 1, in a side of the body casing 3, the air outlet 2*b* is provided to allow air sucked into the body casing 3 to be blown to the outside. The drain pump 60 includes the motor unit 60*b* that drives the drain pump 60 and that is provided above the drain pan 6 and at a level corresponding to the level of the air outlet 2*b*. In the air-conditioning apparatus 100, since the drain pump 60 is provided as described above, refrigerant gas 22 collecting in the drain pan 6 flows upwards from the drain pan 6 and is discharged through the air outlet 2*b*. Thus, the motor unit 60*b* can be kept away from the refrigerant gas 22. It is therefore possible to effectively prevent a dangerous accident such as ignition.

In the air-conditioning apparatus 100 according to Embodiment 1, the drain pan 6 includes the sealing structure 31 that causes condensate water flowing over the wall-surface portion 30 provided on the inner surface of the body casing 3 to continuously flow toward the drain pan. Thus, in the air-conditioning apparatus 100, water droplets that adhere to the wall-surface portion 30 flow over the sealing structure 31 and then flow into the drain pan 6. It is therefore possible to reliably prevent an outflow of condensate water from the indoor unit 2 to the outside thereof, which would occur if a gap is present between the drain pan 6 and the wall-surface portion 30.

Embodiment 2

Figure 9:
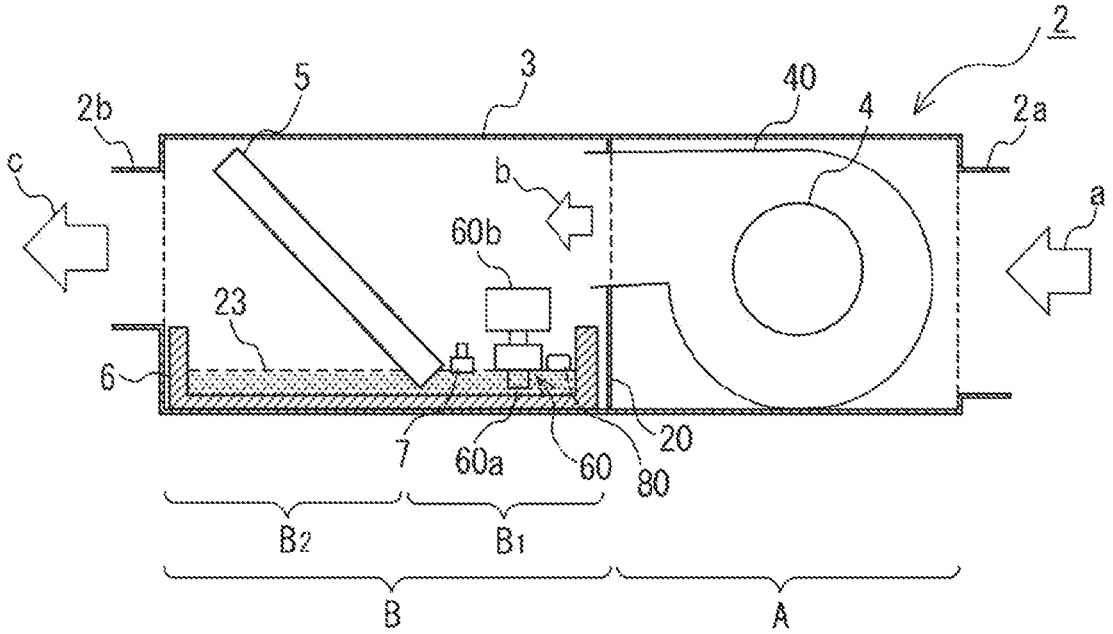
FIG. 9 is a schematic side view of an internal configuration of an indoor unit of an air-conditioning apparatus according to Embodiment 2 of the present disclosure.
Figure 10:
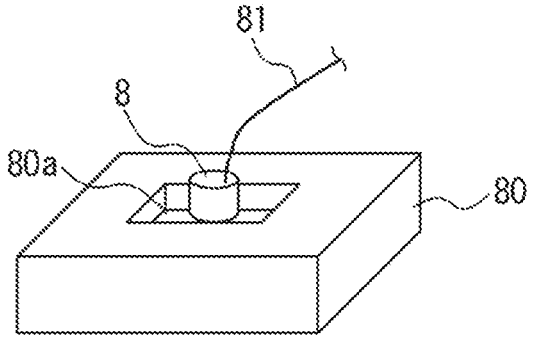
FIG. 10 is a schematic perspective view of a refrigerant-gas detecting unit of the air-conditioning apparatus according to Embodiment 2 of the present disclosure.

An air-conditioning apparatus according to Embodiment 2 of the present disclosure will be described with reference to FIGS. 9 and 10. FIG. 9 is a schematic side view of an internal configuration of an indoor unit of the air-conditioning apparatus according to Embodiment 2 of the present disclosure. FIG. 10 is a schematic perspective view of a refrigerant-gas detecting unit of the air-conditioning apparatus according to Embodiment 2 of the present disclosure. In Embodiment 2, components that are the same as those of the air-conditioning apparatus according to Embodiment 1 will be denoted by the same reference signs, and their descriptions will thus be omitted as appropriate.

As illustrated in FIG. 9, the air-conditioning apparatus according to Embodiment 2 has the same configuration as that of the air-conditioning apparatus 100 according to Embodiment 1 except for the refrigerant-gas detecting unit 8. Although it depends on how the indoor unit 2 is configured, there is a case where it is difficult to provide the refrigerant-gas detecting unit 8 at a higher level than the water-level detecting unit 7. In view of this point, in Embodiment 2, the refrigerant-gas detecting unit 8, as illustrated in FIG. 10, is provided in the drain pan 6 and held by a floating structure 80 made of low-density material that can float on water, and is configured to detect refrigerant gas that has leaked from the indoor heat exchanger 5. The material that can float on water is, for example, foaming polystyrene or vinyl chloride.

The refrigerant-gas detecting unit 8 is provided in a recess 80*a* formed in an upper surface of the floating structure 80 and is connected to the controller 9 by a connecting line 81. In such a manner, the refrigerant-gas detecting unit 8 is provided at the upper surface of the floating structure 80. Thus, the refrigerant-gas detecting unit 8 can be located in the drain pan 6 without considering the position of the water-level detecting unit 7, and is not submerged in condensate water even if the level of the condensate water rises. It should be noted that although it is described above that the water-level detecting unit 7 is provided at the upper surface of the floating structure 80, it is not restrictive, and the water-level detecting unit 7 may be configured in another manner. For example, the water-level detecting unit 7 may be incorporated in the floating structure 80. That is, it suffices that the refrigerant-gas detecting unit 8 is held by the floating structure 80 and can detect refrigerant gas that has leaked from the indoor heat exchanger 5.

In the air-conditioning apparatus according to Embodiment 2, since the water-level detecting unit 7 is held by the floating structure 80 made of material that can float on water, the refrigerant-gas detecting unit 8 can be prevented from being submerged in condensate water that collects in the drain pan 6, and it is possible to reliably prevent a failure to detect a refrigerant gas leak, which would be caused by condensate water collecting in the drain pan 6.

It should be noted that the controller 9 of Embodiment 2 may also cause, based on detection information from the refrigerant-gas detecting unit 8, the notifying unit 90 to give an alarm in order to notify the person or people around the notifying unit 90 of a refrigerant gas leak. Also, the controller 9 may cause, based on detection information from the refrigerant-gas detecting unit 8, the display unit 91 to display information indicating a refrigerant gas leak.

Furthermore, in the air-conditioning apparatus according to Embodiment 2, as illustrated in FIG. 9, the water-level detecting unit 7 that detects the level of condensate water that has flowed into the drain pan 6 is disposed in the drain pan 6. The water-level detecting unit 7 is located in the drain pan 6 and at a higher level than the suction inlet 60*a* of the drain pump 60. When the controller 9 determines, based on detection information from the water-level detecting unit 7, that the level of condensate water collecting in the drain pan 6 reaches the abnormal level, the controller 9 performs control to stop the cooling operation by transmitting a signal to the compressor 11 or the expansion valve 13 to stop the compressor or the valve. The controller 9 may cause, based on detection information from the water-level detecting unit 7, the notifying unit 90 to give an alarm to the person or people around the notifying unit 90. Also, the controller 9 may cause, based on detection information from the water-level detecting unit 7, the display unit 91 to display information. The air-conditioning apparatus according to Embodiment 2 can be put to practical use without including the water-level detecting unit 7.

Although the present disclosure is made by referring to the embodiments, the descriptions concerning the embodiments are not restrictive. For example, the indoor unit 2 is not limited to a ceiling concealed type indoor unit, and may be, for example, of a ceiling suspended type, a wall-mounted type, or a floor-standing type. The configuration of the outdoor unit 1 and that of the indoor unit 2 are not limited to the above configurations. Each of the outdoor unit 1 and the indoor unit 2 can be put to practical use also if each unit includes another component or other components. That is, various modifications, applications, and uses made by a person with ordinary skill in the art as needed fall within the spirit and scope (technical scope) of the present disclosure.

REFERENCE SIGNS LIST

1 outdoor unit, 2 indoor unit, 2*a* air inlet, 2*b* air outlet, 3 body casing, 4 indoor fan, 5 indoor heat exchanger, 6 drain pan, 7 water-level detecting unit, 8 refrigerant-gas detecting unit, 9 controller, 10 refrigerant pipe 11, compressor, 12 outdoor fan, 13 expansion valve, 20, 21 partition plate, 22 refrigerant gas, 23 condensate water, 30 wall-surface portion, 31 sealing structure, 40 fan casing, 41 motor unit, 50 refrigerant-circuit portion, 60 drain pump, 60*a* suction inlet, 60*b* motor unit, 61 drain hose, 61*a* raised portion, 80 floating structure, 80*a* recess, 81 connecting line, 90 notifying unit, 91 display unit, 100 air-conditioning apparatus, 110 building, A fan portion, B heat-exchanger portion, B1 primary side, B2 secondary side

The invention claimed is:

1. An air-conditioning apparatus comprising an outdoor unit and an indoor unit between which refrigerant is circulated, wherein the indoor unit includes a body casing that forms an outer shell, a heat exchanger provided in the body casing, a drain pan provided below the heat exchanger, a water-level detecting sensor configured to detect a level of condensate water that has flowed into the drain pan, and a refrigerant-gas detecting sensor provided in the drain pan and at a higher level than the water-level detecting sensor, and configured to detect refrigerant gas that has leaked from the heat exchanger, the air-conditioning apparatus comprising a controller configured to perform control to stop a cooling operation when the water-level detecting sensor detects condensate water that collects in the drain pan, wherein the indoor unit includes a drain pump configured to draw the condensate water that collects in the drain pan and to discharge the condensate water to an outside of the indoor unit, and wherein the controller performs control to stop driving of the drain pump when the refrigerant-gas detecting sensor detects the refrigerant gas.

2. The air-conditioning apparatus of claim 1, further comprising:

a notifying unit configured to make a notification indicating an operation state of the outdoor unit and an operation state of the indoor unit, wherein the controller causes the notifying unit to make the notification based on detection information from the water-level detecting sensor or the refrigerant-gas detecting sensor.

3. The air-conditioning apparatus of claim 1, further comprising:

a display unit configured to display information indicating an operation state of the outdoor unit and an operation state of the indoor unit, wherein the controller causes the display unit to display the information based on detection information from the water-level detecting sensor or the refrigerant-gas detecting sensor.

4. An air-conditioning apparatus comprising an outdoor unit and an indoor unit between which refrigerant is circulated, wherein the indoor unit includes a body casing that forms an outer shell, a heat exchanger provided in the body casing, a drain pan provided below the heat exchanger, and a refrigerant-gas detecting sensor provided in the drain pan and held in a recess formed on an upper surface of a floating structure made of material capable of floating on water, and configured to detect refrigerant gas that has leaked from the heat exchanger, a drain pump configured to draw the condensate water that collects in the drain pan and discharges the condensate water to an outside, and a controller that performs control to stop driving of the drain pump when the refrigerant-gas detecting sensor detects the refrigerant gas.

5. The air-conditioning apparatus of claim 4, further comprising:

a notifying unit configured to make a notification indicating an operation state of the outdoor unit and an operation state of the indoor unit; and a controller configured to cause the notifying unit to make the notification based on detection information from the refrigerant-gas detecting sensor.

6. The air-conditioning apparatus of claim 4, further comprising:

a display unit configured to display information indicating an operation state of the outdoor unit and an operation state of the indoor unit; and a controller that causes the display unit to display the information based on detection information from the refrigerant-gas detecting sensor.

7. The air-conditioning apparatus of claim 1, wherein the body casing has an air outlet that is provided in a side of the body casing to allow air sucked into the body casing to be blown out of the body casing, and wherein the drain pump includes a motor unit configured to drive the drain pump and provided above the drain pan and at a level corresponding to the air outlet.

8. The air-conditioning apparatus of claim 1, wherein the drain pan is provided with a sealing structure to cause condensate water that flows over a wall-surface portion provided on an inner surface of the body casing to continuously flow toward the drain pan.

9. The air-conditioning apparatus of claim 4, wherein the body casing has an air outlet that is provided in a side of the body casing to allow air sucked into the body casing to be blown out of the body casing, and wherein the drain pump includes a motor unit configured to drive the drain pump and provided above the drain pan and at a level corresponding to the air outlet.

10. The air-conditioning apparatus of claim 4, wherein the drain pan is provided with a sealing structure to cause condensate water that flows over a wall-surface portion provided on an inner surface of the body casing to continuously flow toward the drain pan.

* * * * *